US006482106B2

(12) United States Patent
Saso

(10) Patent No.: US 6,482,106 B2
(45) Date of Patent: Nov. 19, 2002

(54) WOOD-TYPE CLUB

(75) Inventor: Mitsuhiro Saso, Iida 291-11, Himeji-shi, Hyogo 670-0974 (JP)

(73) Assignees: Tadashi Nakata, Hyogo (JP); Mitsuhiro Saso, Hyogo (JP)

( * ) Notice: Subject to any disclaimer, the term of this patent is extended or adjusted under 35 U.S.C. 154(b) by 0 days.

(21) Appl. No.: 09/777,926

(22) Filed: Feb. 7, 2001

(65) Prior Publication Data

US 2001/0027139 A1 Oct. 4, 2001

(30) Foreign Application Priority Data

Feb. 7, 2000 (JP) ..... 2000-029076

(51) Int. Cl.[7] ..... A63B 53/04
(52) U.S. Cl. ..... 473/327
(58) Field of Search ..... 473/324, 327, 473/328, 345, 346, 350, 228; D21/733, 734, 759

(56) References Cited

U.S. PATENT DOCUMENTS 3,068,011 A * 12/1962 Sano
4,065,133 A * 12/1977 Gordos
D275,412 S * 9/1984 Simmons
5,203,565 A * 4/1993 Murray
5,505,448 A * 4/1996 Park
5,954,595 A * 9/1999 Antonious
5,980,394 A * 11/1999 Domas
5,989,134 A * 11/1999 Antonious

FOREIGN PATENT DOCUMENTS

JP 6-098954 4/1994

* cited by examiner

*Primary Examiner*—Sebastiano Passaniti
(74) *Attorney, Agent, or Firm*—Nixon Peabody LLP; Thomas W. Cole

(57) ABSTRACT

The present invention provides a wood-type club constituted such that the toe-down effect and the covering effects of the head can be more reliably suppressed. Attitude-correcting portions (30, 31) extending from the impact face (11) side to the back (14) side of the head are provided in at the least the toe (T) side and the heel (H) side of the head relative to a center line passing longitudinally through the head center of gravity in either the side parts (15, 16) or the sole (13) of the head (10), and are formed such that a portion of the highspeed airflow impacting the head at downswing is captured by at the least two attitude-correcting portions, either maintaining the head in a proper attitude, or correcting the head to a proper attitude.

5 Claims, 6 Drawing Sheets

WOOD-TYPE CLUB

BACKGROUND OF THE INVENTION

1. Field of the Invention

The present invention relates to a wood-type club, and more particularly to a club constituted so as to more reliably suppress the toe-down effect and covering effects of the head.

2. Description of the Related Art

From the standpoint of making a good score in a golf competition, the importance of striving for directional stability of a ball hit by a golf club is well known, and a variety of golf clubs that improve the head shape and the head center of gravity have been proposed. The inventors of the present case, too, have already developed and proposed an iron-type club and a wood-type club constituted so as to enhance the directional stability of a hit ball by suppressing the toe-down effect and covering effects of the head (Refer to Japanese Laid-open Patent Application Nos. H04-227285 and 06-98954).

However, even in the clubs related to the developments of the inventors of the present case, there are times when the toe-down effect and covering effects of the head occur caused either by shaft characteristics or by the physical condition or emotional state of a golfer during a competition, and there was room for improvement from this standpoint.

SUMMARY OF THE INVENTION

With the foregoing in view, an object of the present invention is to provide a wood-type club constituted so as to enable the more reliable suppression of the toe-down effect and covering effects of the head.

The inventors of the present case have conducted all manner of research on the toe-down effect and the covering effects of a head. Firstly, when a golf club is swung, centrifugal force acts on the club, and this centrifugal force is a force, which, when one end of a string to which a weight is suspended is held and swung around, radially pulls the weight such that the weight rotates circumferentially having the string as a radius.

In general, because a head protrudes laterally more than the central axis of a shaft, when centrifugal force acts on the head at downswing, there is a tendency for the shaft to bend downwards. On the other hand, as shown in FIG. 6, in a case in which a golf club is swung, the golf club is locked by the wrists 120, but when the wrists 120 have been considered as a mechanism element constituting the center of rotation, the rigidity of the wrists 120 is around $1/9^{th}$ that of the shaft 100, so that the wrists 120 are not able to sustain the angle at the time of address due to the centrifugal force acting on the head 110, and the angle of the wrists becomes larger, the golf club is displaced downward (see state A and state B of FIG. 6), and thereafter, the shaft 100 bends downward (see state C of FIG. 6), and in accordance therewith, the toe-down effect of the head 110 occurs, decreasing head speed such that the flight stability of a golf ball is adversely affected.

Further, when a golfer swings a golf club, he attempts to swing the club the same all the time, but in actuality, the timing of a swing is apt to be off due to the golfer's physical or emotional state that day. Further, there are also times when the characteristics of a shaft do not coincide with a golfer's timing. In such cases, either the shaft 100 bends as shown in FIG. 7, or the shaft 100 twists around the central axis as shown in FIG. 8, and at the point of impact with a ball, the head 110 constitutes a closed state as compared to a square state, in accordance therewith causing the covering effects of the head 110 such that the flight stability of a golf ball is adversely affected.

Now then, when an ordinary golfer swings a wood club, the head speed reaches around 150 kilometers per hour (km/h). The inventors of the present case conjectured that if the highspeed airflow impacting a head when the head is moving at high speed were to be utilized such that the head attitude is maintained and corrected, the decrease in head speed will be held in check by enabling the head toe-down effect and covering effects to be more reliably suppressed, and the present invention was brought to completion.

Accordingly, a wood-type club related to the present invention is characterized in that attitude-correcting portions are disposed in at the least the toe side and heel side of the head extending from the impact face side toward the back side of the head relative to a center line, which passes longitudinally through the center of gravity of the head, in either the side parts or sole of the head, and the above-mentioned at the least two attitude-correcting portions are constituted such that they capture a portion of the highspeed airflow impacting the head at the downswing of the head, either maintaining the head in a proper attitude, or correcting the head to the proper attitude.

The attitude-correcting portions are the parts of the head capture the highspeed airflow behaving exactly as cylindrical guiding bodies going from the impact face side to the back side of the head.

One characteristic of the present invention is the fact that attitude-correcting portions are formed in at the least the heel side and toe side of a head in either the side parts or sole of the head.

In accordance therewith, when a club is swung at approximately 150 km/h, for example, a portion of the highspeed airflow impacting the head is captured by the attitude-correcting portions, and because the captured highspeed airflow thereof is high speed, the attitude-correcting portions thereof behave exactly as cylindrical guiding bodies going from the impact face side to the back side of the head. Thus, since at the least two cylindrical guiding bodies guide the toe side and the heel side of the head when the head moves circumferentially having a golfer's wrists as the center, and having the length of the shaft as the radius, the head is maintained in a square attitude relative to a golf ball, and, in addition, even if the head attempts to toe down, the cylindrical guiding body on the head toe side holds the position of the head toe side, preventing the toe-down effect.

Further, if the head either opens or closes from a square attitude, since the highspeed airflow interferes with the attitude-correcting portions, and this interference acts as a force for correcting the head to the square attitude, the head is corrected to a square attitude at the moment of impact with a golf ball.

According to the experiments of the inventors of the present case, it was confirmed that the effect of maintaining and correcting head attitude in accordance with at the least two attitude-correcting portions is remarkable, and that a head can be controlled to the optimum attitude at all times regardless of the stiffness of the shaft, or the physical or emotional state of the golfer. Therefore, a golfer can freely select a shaft of a stiffness that meets with his preference, and can make a score that accords with his capabilities at all times regardless of his physical or emotional state.

The attitude-correcting portions either can be formed by cutting them into a head, or can be formed by building them up on the outside surface of a head. Further, the attitude-correcting portions either can be disposed in the side parts of a head, or can be disposed in the sole.

Furthermore, there can be two or more attitude-correcting portions if they are disposed at the least in the toe side and heel side. Here, the reason for disposing an attitude-correcting portion in the toe side and in the heel side is because the highspeed airflow of only one cylinder of either the toe side or the heel side is not able to maintain and correct head attitude.

An attitude-correcting portion can be a simple through-hole, but from the standpoint of present-day rules of competition, if a through-hole is provided, the club cannot be used in competition. Accordingly, an attitude-correcting portion can constitute a concave groove extending from the impact face side to the back side of the head.

The concave groove thereof can be formed by cutting groove into a head, or a built-up portion can be formed on the external surface of a head, and a concave groove can be formed by cutting groove into the built-up portion thereof.

An attitude-correcting portion is not particularly limited to a concave groove shape, but rather can employ a sectional U-shape, a sectional semicircular shape, a sectional elliptical shape, a sectional triangular shape, other sectional polygonal shapes, or an optional sectional shape, but from the standpoint of guiding the head, it is preferable to use a shape such that a cylindrical highspeed airflow cannot readily escape from an attitude-correcting portion of a head. That is, it is desirable that a concave groove constitute a sectional shape for which the opening width thereof is either the same as the maximum groove width or smaller than the maximum width. Provided it satisfies this condition, the sectional shape of a concave groove is not particularly limited.

Further, from the standpoint of suppressing toe-down, it is preferable to use a shape such that the head cannot readily escape downwardly from a cylindrical highspeed airflow. That is, for a concave groove, it is desirable that the opening thereof be set either in the horizontal direction, or downwardly from the horizontal direction relative to a head in a square attitude. Of course, in a case in which the opening width of a concave groove is made smaller than the maximum groove width, since a cylindrical highspeed airflow cannot readily escape from the concave groove even when the opening of the concave groove is oriented either upward, or diagonally upward, it is possible to suppress the toe-down effect.

The size of a concave groove must be set in accordance with a variety of conditions, such as the weight of the head, and the muscular strength of the golfer, but according to the experiments of the inventors of the present case, it was confirmed that the anticipated effect could be achieved if the diameter is roughly 5 mm or larger. However, in a case in which a plurality of concave grooves are formed in the toe side and heel side, respectively, since a plurality of high-speed airflows collectively guide the head, the diameter can be 5 mm or less.

BRIEF DESCRIPTION OF THE DRAWINGS

A complete understanding of the invention may be obtained from the foregoing and following description thereof, taken in conjunction with the appended drawings, in which.

DESCRIPTION OF THE PREFERRED EMBODIMENTS

Figure 1:
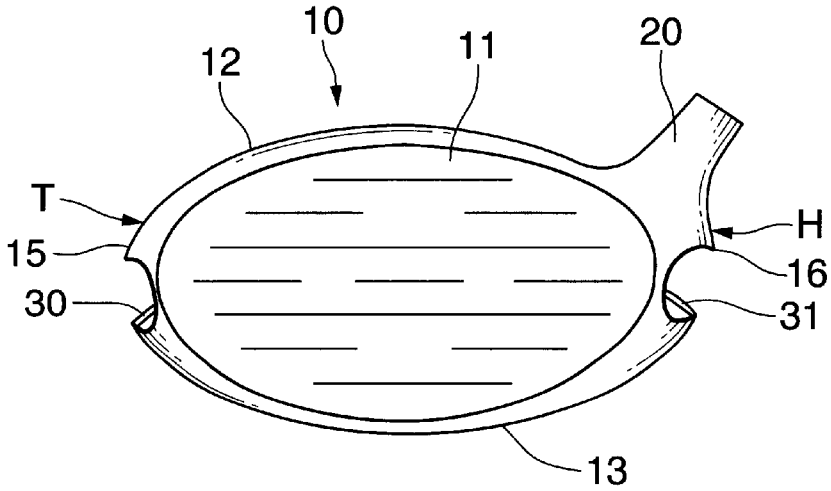
FIG. 1 is a front view showing a preferred embodiment of a wood-type club related to the present invention.
Figure 2:
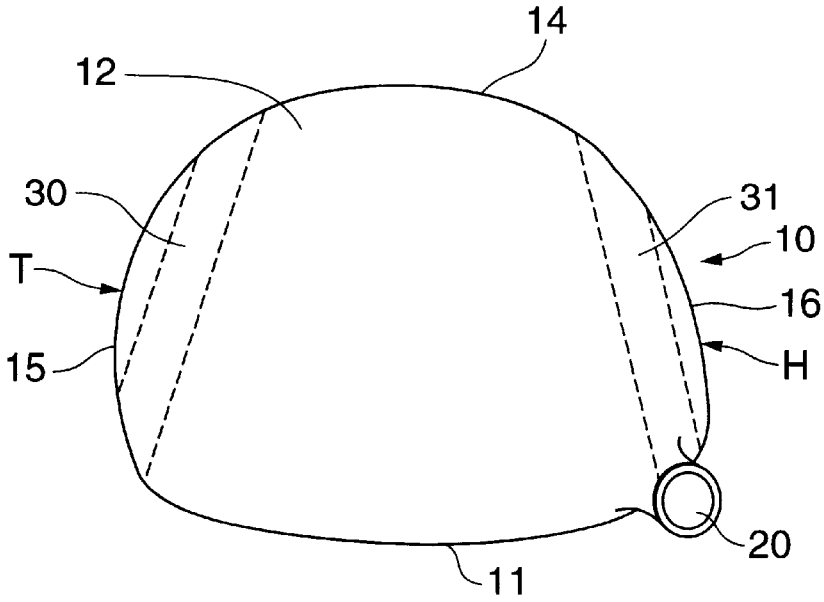
FIG. 2 is a plan view showing the above-mentioned embodiment.
Figure 3:
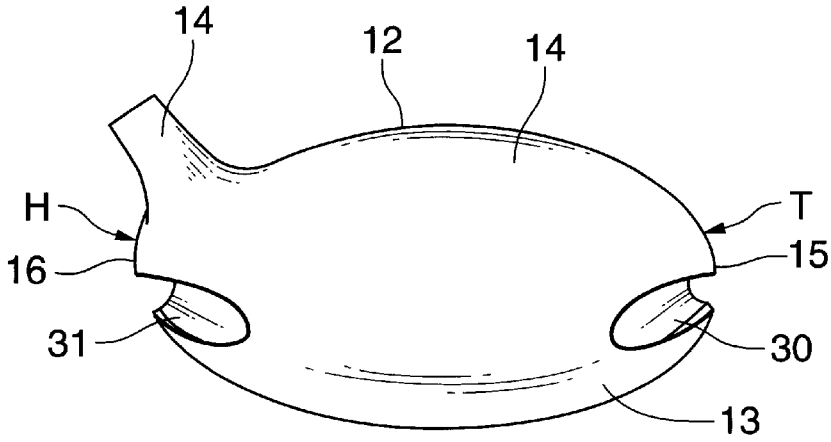
FIG. 3 is a rear view showing the above-mentioned embodiment.
Figure 4:
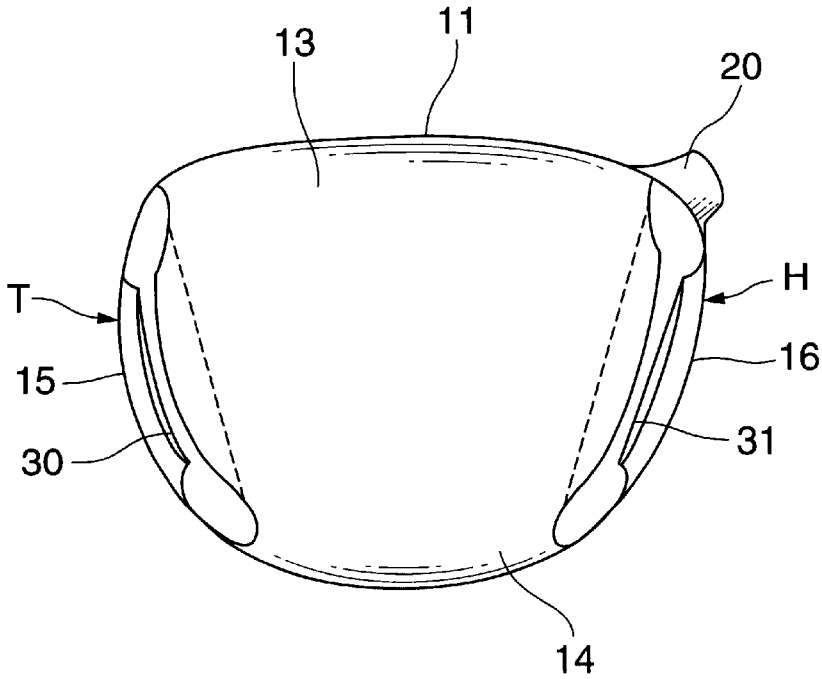
FIG. 4 is a bottom view showing the above-mentioned embodiment.

The present invention will be explained in detail hereinbelow based on a specific example. FIG. 1 through FIG. 5 show preferred embodiments of a wood-type club related to the present invention. In the figures, the head 10 is a hollow casted part (or a hollow forged part) integrally formed with a hosel 20 for connecting a shaft 40 to the heel side, and the head is constituted from an impact face 11, a top face 12, a sole 13, and a back 14, and the sweet spot forms a spherical shape on the impact face 11.

Further, concave grooves (attitude-correcting portions) 30, 31 are cut into the side parts 15, 16 of the toe side T and the heel side H of the head 10 extending from the impact face 11 to the back 14 so as to intersect the center line that passes through the head center of gravity.

The concave grooves 30, 31 thereof form a sectional practically circular shape of a diameter of practically 12 mm, and the opening width is either smaller than the maximum groove width, or the openings of the concave grooves 30, 31 are set oriented slightly diagonally downward from horizontal.

Figure 5:
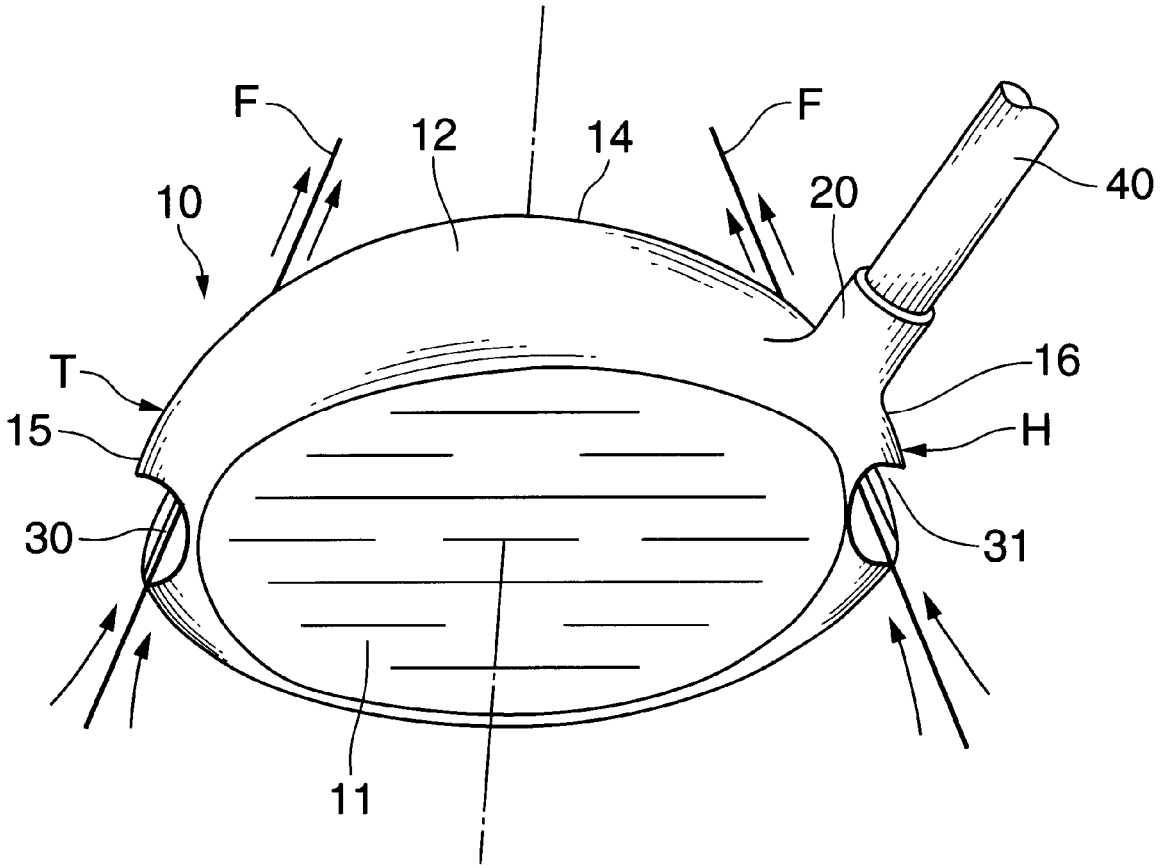
FIG. 5 is a schematic diagram for illustrating the operation of the above-mentioned embodiment.
Figure 6:
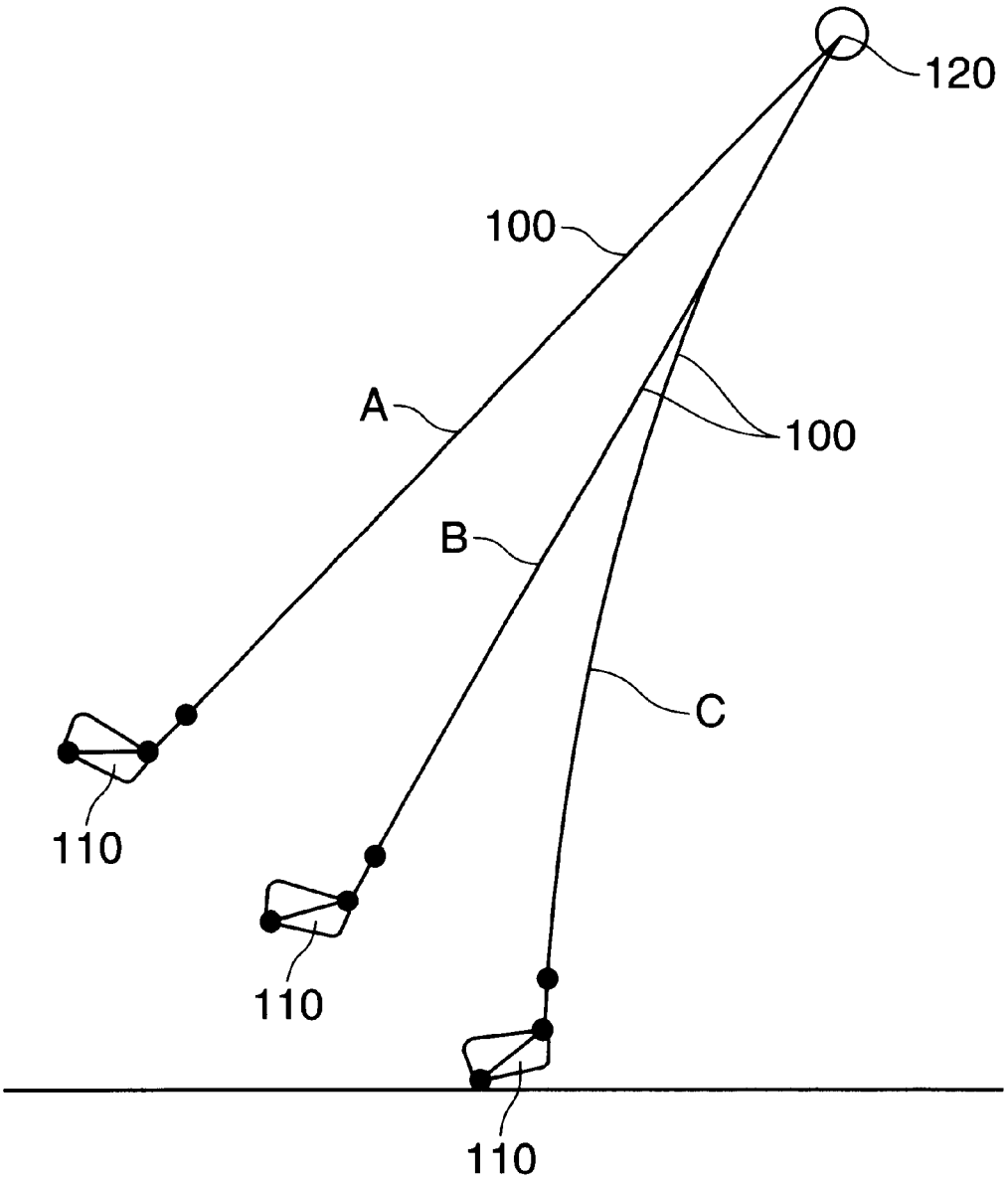
FIG. 6 is a diagram for illustrating the cause of the toe-down effect.
Figure 7:
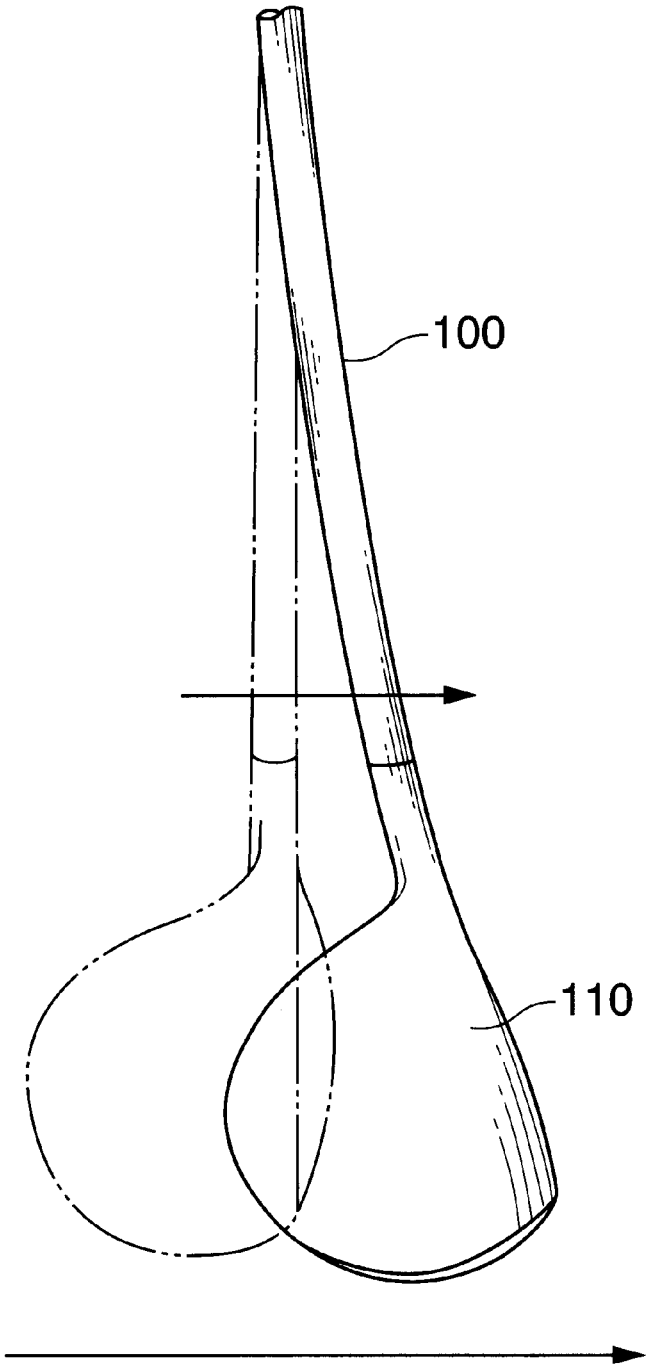
FIG. 7 is a diagram for illustrating the cause of covering effects.
Figure 8:
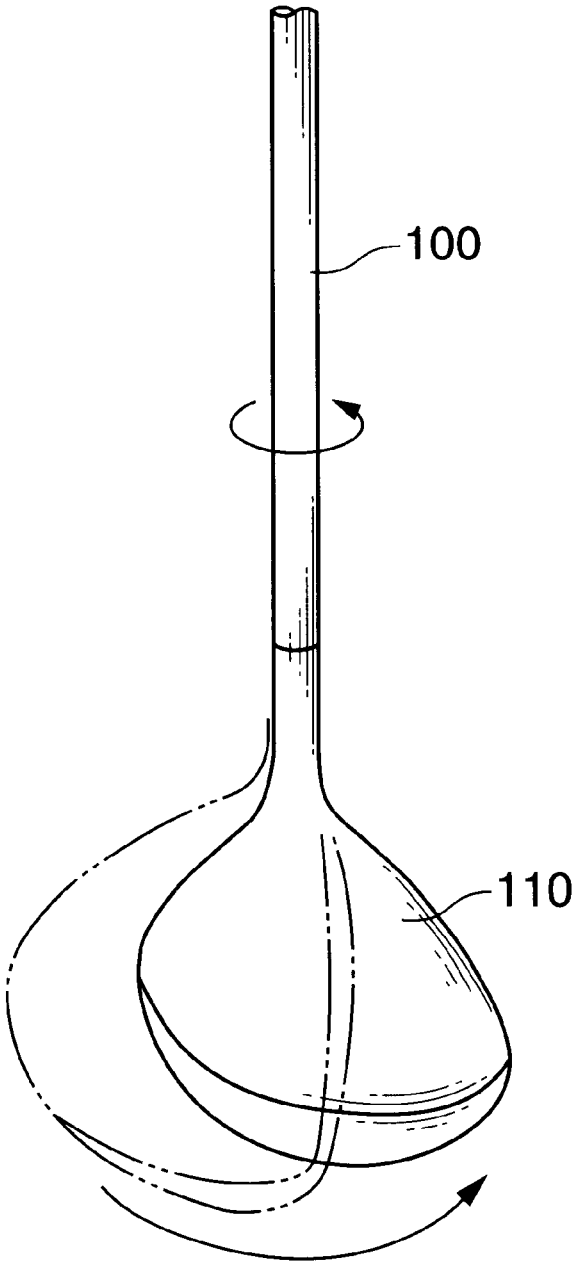
FIG. 8 is a diagram for illustrating another cause of covering effects.

When swinging the club of the present example, and starting the downswing from the backswing, as shown in FIG. 5, a cylindrical highspeed airflow (guiding body) F begins to form in the concave groove 31 of the heel side H of the head 10, and this acts as a force for setting the head 10 in a square attitude. When the head 10 begins to constitute a square attitude from an open state, a cylindrical highspeed airflow F also forms in the concave groove 30 of the toe side T.

Thus, the head 10 is guided by two cylindrical highspeed airflows F, F of the toe side T and the heel side H, and the head 10 is maintained in a square attitude relative to a golf ball. Further, since the highspeed airflow F of the toe side T is held inside the concave groove 30 of the toe side T of the head 10, and does not escape from the concave groove 30, the highspeed airflow 30 functions such that even if the head 10 attempts to toe down, this is held in check, and in accordance therewith, the toe-down effect is more reliably suppressed.

Further, if, for whatever reason, the head 10 should open or close, because the two highspeed airflows F, F impact the inner surfaces of the concave grooves 30, 31 and generate a force for returning the head 10 to the square attitude, the head 10 is corrected to the square attitude.

Therefore, since the head 10 is constantly in a square attitude, and moreover, is not toe-down at the moment it impacts a golf ball, the golf ball will fly stably in the targeted direction.

According to the experiments of the inventors of the present case, whereas, with a conventional head, the amount of toe-down was practically 15 mm, and 17.5° of covering was generated, with a head of the present example, the amount of toe-down was less than 3 mm, and there was either a square or a 1.0° open face, confirming that the toe-down effect and covering effects can be greatly suppressed.

What is claimed is:

1. A wood-type club, in which there are at the least two disposed concave groove attitude-correction portions extending from an impact face side to a back side of the head in at the least a toe side and a heel side of the head relative to a center line passing longitudinally through the head center of gravity in the side parts of the head, wherein an extension of each of said at the least two attitude-correcting portions cross each other behind the back side of the head, and said at the least two attitude-correcting portions are formed so as to capture a portion of the highspeed airflow impacting the head at downswing and form a highspeed air body which acts as a cylindrical guide member, either maintaining the head in a proper attitude, or correcting the head to a proper attitude.

2. The wood-type club according to claim 1, wherein said attitude-correcting portion is formed by cutting into the head.

3. The wood-type club according to claim 1, wherein said concave groove forms a sectional shape for which the opening width thereof is either the same as the maximum groove width or smaller than the maximum width.

4. The wood-type club according to claim 1, wherein said concave groove is provided either in a horizontal direction or downwardly from a horizontal direction relative to a head in a square attitude.

5. A golf club head comprising:

at the least two concave groove attitude-correction portions disposed in the head, said at the least two concave groove attitude-correction portions extending from an impact face side to a back side of the head in at the least a toe side and a heel side of the head relative to a center line passing longitudinally through the head center of gravity in the side parts of the head, said at the least two attitude-correcting portions being substantially linear and formed so as to capture a portion of the highspeed airflow impacting the head at downswing and form a highspeed air body which acts as a cylindrical guide member to either maintain the head in a proper attitude or correct the head to a proper attitude, wherein a substantially linear extension of each said at the least two attitude-correcting portion cross each other behind the back side of the head.

* * * * *